US006240609B1

(12) United States Patent
Rasnick, Jr. et al.

(10) Patent No.: US 6,240,609 B1
(45) Date of Patent: Jun. 5, 2001

(54) APPARENT SPACE-DYED YARNS AND METHOD FOR PRODUCING SAME

(75) Inventors: Lawrence E. Rasnick, Jr., Bristol, VA (US); Arnold L. Belcher, Jr., Bristol, TN (US)

(73) Assignee: Prisma Fibers, Inc., Bristol, VA (US)

( * ) Notice: Subject to any disclaimer, the term of this patent is extended or adjusted under 35 U.S.C. 154(b) by 0 days.

(21) Appl. No.: 09/443,148

(22) Filed: Nov. 18, 1999

(51) Int. Cl.[7] ..... D02J 11/00
(52) U.S. Cl. ..... 28/258; 28/263; 28/271
(58) Field of Search ..... 28/247, 258, 265, 28/263, 271, 248, 274, 220, 221; 57/333, 350, 908

(56) References Cited

U.S. PATENT DOCUMENTS

| | | | | |
|---|---|---|---|---|
| 3,604,197 | | 9/1971 | Saidaiji et al. . | |
| 3,802,177 | | 4/1974 | Sekiguchi et al. . | |
| 3,899,562 | | 8/1975 | Seidl . | |
| 3,994,122 | | 11/1976 | Shah . | |
| 4,025,595 | * | 5/1977 | Mirhej | 28/271 |
| 4,068,459 | * | 1/1978 | Movshovich et al. | 57/156 |
| 4,153,961 | | 5/1979 | Cleveland . | |
| 4,173,678 | | 11/1979 | Hennes et al. . | |
| 4,196,241 | | 4/1980 | Van Anholt et al. . | |
| 4,218,869 | * | 8/1980 | Newton | 57/245 |
| 4,226,079 | | 10/1980 | Mountney et al. . | |
| 4,299,015 | * | 11/1981 | Marcus et al. | 28/265 |
| 4,341,063 | * | 7/1982 | Southerlin et al. | 28/271 |
| 4,343,146 | * | 8/1982 | Nelson | 28/271 |
| 4,472,481 | | 9/1984 | Snooks, Jr. et al. . | |
| 4,712,366 | | 12/1987 | Tsujimoto et al. . | |
| 5,148,586 | | 9/1992 | Coons, III . | |
| 5,223,197 | | 6/1993 | Boles et al. . | |
| 5,251,263 | | 10/1993 | Gerhards et al. . | |
| 5,284,009 | | 2/1994 | Tung et al. . | |
| 5,327,622 | * | 7/1994 | Coons et al. | 28/271 |
| 5,364,701 | | 11/1994 | Boles et al. . | |
| 5,413,857 | | 5/1995 | Hagen et al. . | |
| 5,486,417 | | 1/1996 | Hagen et al. . | |
| 5,489,475 | | 2/1996 | Hagen et al. . | |
| 5,512,367 | | 4/1996 | Hagen et al. . | |
| 5,590,447 | * | 1/1997 | Goineau | 28/271 |
| 5,591,523 | | 1/1997 | Aneja . | |
| 5,593,751 | | 1/1997 | Yu et al. . | |
| 5,613,285 | | 3/1997 | Chester et al. . | |
| 5,691,057 | | 11/1997 | Bennie et al. . | |
| 5,715,584 | | 2/1998 | Coons, III et al. . | |
| 5,775,087 | | 7/1998 | Goineau . | |
| 5,804,115 | | 9/1998 | Burton et al. . | |
| 5,858,290 | | 1/1999 | Oh et al. . | |
| 6,085,395 | * | 7/2000 | Weiss | 28/247 |
| 6,105,224 | * | 8/2000 | O'Mara, Jr. et al. | 28/247 |

* cited by examiner

*Primary Examiner*—Amy B. Vanatta
(74) *Attorney, Agent, or Firm*—Miles & Stockbridge P.C.; John C. Kerins

(57) ABSTRACT

A process for combining single color feed yarns, either dyed or melt pigmented, without twisting or heat-setting, to form an apparent space-dyed yarn product. The process includes the sequential steps of individually and simultaneously drawing two or more pre-spun, pre-colored singles yarns, at least one of which is differentially colored with respect to the other yarns; individually and simultaneously texturing the two or more yarns; individually and simultaneously entangling the two or more textured yarns in a first air-jet entangling process to form respective two or more entangle-sequenced yarns each having sequences of entangled and unentangled fibers; together air-jet entangling the two or more sequences of entangled and unentangled fiber yarns in a second air-jet entangling process to form a final apparent space-dyed yarn; and winding up the final apparent space-dyed yarn.

8 Claims, 3 Drawing Sheets

APPARENT SPACE-DYED YARNS AND METHOD FOR PRODUCING SAME

BACKGROUND OF THE INVENTION

1. Field of the Invention

The present invention relates to bulked continuous filament (BCF) bundled yarns, and, more particularly, to bulked continuous filament bundled yarns made from differently colored singles yarns wherein the bundled yarns are capable of providing space-dyed effects in tufted floor coverings.

2. Description of Related Art

As used herein, certain terms have the meanings ascribed to them as follows:

The terms "thread" and "filament" are intended to connote single filament fibers, whereas "singles yarn" or "strand" is an assembly of two or more threads or filaments.

The term "node" is intended to mean relatively compact, tangled sections of a yarn that are separated by relatively bulky or unentangled sections.

The term "entangling" is intended to mean the mixing of fiber components to an extent that the individual components cohere to one another, where "cohere" means to stick or hold together in a visually identifiable and distinguishable mass, an example of which is the above-mentioned "node". Entangling includes directing a flow of fluid, such as air, against a moving plurality of strands transversely of the direction of movement of the strands. The resulting dislocation of the strands leads to a knot-like intertwining and entangling of the strands. The term "air-jet entangler" is a device which achieves an entangled yarn by co-mingling the components of the yarn.

A "texturing process" causes a permanent departure from the original longitudinal shape of the filament, for example, by causing the filament to be crimped, or to have some degree of curved or angular change along its length. One example of a texturing process employs a chamber in which a yarn is moved at high speed through a flow of heated gas or vapor, i.e., hot air or steam. Alternatively, heated or unheated yarn may be moved at high speed through a mechanical crimping process. In either arrangement, the fiber is then bulked by collision with a surface which, for practical purposes, may be the wad or plug formed by the yarn itself. As a consequence, individual yarns deposit themselves in a regularly bent configuration on an impact surface, and because of heat-induced effects, the yarns to some degree retain this curved or angular configuration. In the embodiment in which the fiber is heated with air, the crimped fiber configuration is made permanent by a cooling process, without permitting portions of the yarn to adhere, or be connected, to each other.

Singles yarns may be combined into plied yarns in several ways that usually involve the use of texturing of filaments followed by air-jet entangling. For example, three separate singles yarns can be combined into a final BCF product. The process may be a "one-step" or "two-step" process. The one-step process begins with forming the spun filaments making up the yarns and continues through all subsequent steps to winding of the final product, without interim spooling. In known two-step processes, the spun yarns are wound up after the first step of spinning, drawing, and texturing. The second step typically involves unwinding the yarn from a storage spool, which includes precision tension control before commencing the entangling step.

Both the one-step and two-step processes often employ a number of known steps, however, various permutations of those steps, together with uniquely selected parameter settings, determine which of a wide variety of results are achieved, in terms of filament and yarn configuration, and/or in terms of the appearance and performance of the ultimate product produced using such yarns. A specific sequence of process steps, along with a corresponding selection of process parameters, such as temperature, yarn tension, and other particulars, can determine a unique and possibly unforeseeable result, in terms of yarn specifications and functional and appearance qualities of a carpet made from the yarn.

One particular BCF yarn product is a space-dyed yarn, which has repeated, random or regular, intense bands of different colors along its length, which provide unique accent styling, primarily, but not exclusively, in tufted floor coverings, such as carpets. Such carpet products are normally manufactured by post-coloring of uncolored spun yarns with dyestuffs in an intermittent, regular or random, fashion. The yarns are then (ply)twisted and heat set. An example of such methods may be found in U.S. Pat. No. 4,153,961. Such yarns, when fully processed into carpet face yarns, exhibit pinpoints or larger "pixels" of different colors against a more mixed background shading. Depending on the regularity of spacing between colors, and the length of the different colors present in the yarns, the carpet can also feature a wider repeat patterning of areas of single perceived shade and areas of pinpoints of bright colors against a background of the single perceived shade.

Such effects are, to a large extent, different from those achieved with socalled "heather" yarns. Heather yarns, while also containing different colors, are mixed in such a way during processing that no one color predominates, and a single shade is perceived in carpeting made from such yarns, except on very close inspection. A heather appearance includes small points of individual color, i.e., color points, randomly distributed throughout a matrix of contrasting colors. In contrast to processes for making space-dyed yarn products, processes for making heather yarns are formulated to prevent the formation of any directional carpet appearance or patterns, such as streaks and chevrons in the finished product.

In order to eliminate the complex dyeing processes used to manufacture "true" space-dyed yarns, attempts have been made to utilize yarns which have been pre-colored in single colors, either by dyeing or by melt pigmentation. Such pre-colored singles yarns have been combined, in groups of two or more, with at least one group being of a different color than the others, to provide final yarns with a variety of coloring effects. The specific sequence of the process steps is as important as the selected steps, themselves. Such yarn products are referred to as "apparent space-dyed yarns" as their effects in a tufted product make them appear to be space-dyed yarns.

U.S. Pat. No. 5,804,115 discloses a one-step process for producing an apparent space-dyed yarn, made by sequentially spinning two or more strands having two or more colors, forming two or more yarn fractions from the strands, independently texturing and entangling at least one of the yarn fractions, and then together entangling all of the yarn fractions. This arrangement suffers from restrictions on process control flexibility, because it is performed as a one-step process. In a one-step process, fibers are spun at a minimum viable rate, e.g., 500 m/min., which, at a conventional 3:1 draw ratio, results in a downstream feed rate of 1500 m/min. At this rate, a desired level of precision in the downstream processing, in particular, in the air-jet entangling, cannot be attained. As a result, the space-dye effect of the yarn product when tufted into carpet is not as pronounced or as crisp as it otherwise might be.

The above process and products are, to varying degrees, unsatisfactory in terms of complexity, and/or their inability to provide the range of effects required to simulate true space-dyed yarns. Thus, there remains a need for a process for producing a simple, effective, product yarn series which can match all of the effects possible using true space-dyed yarns, and to produce other unique effects not possible by other means.

SUMMARY OF THE INVENTION

The present invention provides a process for combining a plurality of single color feed yarns, either dyed or melt pigmented, without twisting or heat-setting, to form an apparent space-dyed yarn product which closely approaches the aesthetic and design requirements of a true space-dyed yarn. Advantageously, the process preferably uses melt pigmented, also known as solution-dyed, singles yarns, which have been found to offer superior end-use performance, e.g., low color fade, and resistance to harsh cleaning methods.

The present invention includes a process for making apparent space-dyed bulked continuous filament yarn employing the sequential steps of: (a) individually and simultaneously drawing two or more pre-spun, pre-colored singles yarns, at least one of which is differentially colored with respect to the other yarns; (b) individually and simultaneously texturing the two or more yarns; (c) individually and simultaneously air-jet entangling the two or more textured yarns in a first air-jet entangling process to form respective two or more entangle-sequenced yarns each having fiber portions having segments of entangled and unentangled fibers; (d) together air-jet entangling the two or more segments of entangled and unentangled fiber yarns in a second air-jet entangling process to form a final apparent space-dyed yarn; and (e) winding up the final apparent space-dyed yarn.

The texturing step involves mechanically crimping the yarn by moving the yarn at high speed through frictional rolls pressed together, thereby forming a rectilinear, two dimensional zig-zag pattern. Alternatively, the yarn may be moved through a flow of heated gas or vapor, i.e., hot air or steam, to form a curvilinear profile, after which the yarn is bulked by collision with a surface which, for practical purposes, may be the wad or plug formed by the strand itself.

The first air-jet entangling step includes, for each singles yarn, a respective, individual entangler, which is arranged to provide pre-determined patterns of on-off cycles of pressurized air through jets, which results in segments of entangled and unentangled fibers in the respective singles yarn. Each individual jet in the first entangling process operates on the same, or optionally, on a different timing sequence as the other jets, and the sequences themselves may be even or uneven, i.e., the time-on interval may be the same as, or different than, the time-off interval.

The second air-jet entangling step employs a further entangler, and the entangling which is carried out on the final, combined yarn, is also programmably controlled, and operates under the same, or, optionally, a different, timing sequence as that of the first set of air-jet entanglers.

According to the present invention, the timing sequence control of the first and second air-jet entangling processes preferably is electronically programmed in such a manner as to controllably entangle the drawn and textured singles yarns in an intermittent, regular or random, fashion. This makes possible the manufacture of a wide range of color effects in the final yarn product. This method for processing multi-colored yarn produces a yarn which effectively duplicates all effects possible with traditional space-dyed yarns, and does so with a limited palette of colors. Moreover, the process of the invention offers unique styling possibilities not available by any other means.

Other aspects of the yarn processing sequence, including drawing, texturing and winding, utilize equipment and techniques for such processes which are known to those skilled in the art.

Therefore, it is a principal object of the present invention to provide an apparatus and process to produce a yarn product that can duplicate all effects possible with true space-dyed yarns.

A further principal object of the present invention is to provide a process for making apparent space-dyed yarn that features sequences of "heather" type mixed color, along with sequences where selected colors are each separately visible on turning the yarn, whereby, when tufted into a carpet, the perceived color effect is comparable to that provided by true space-dyed yarns in such carpet products.

It is a further object to provide a process for making apparent space-dyed yarn which can be used to provide a broad range of potential effects, using only a limited palette of colors.

Still another object of the present invention is to provide a process for making apparent space-dyed yarn that offers unique styling possibilities not available by other processing means.

Another object of the present invention is to provide a process for making apparent space-dyed yarn which uses melt pigmented singles yarns.

Another object of the present invention is to provide a process for making a ready-to-tuft apparent space-dyed yarn that does not include the steps of twisting or heat-setting.

Another object of the present invention is to provide a process for making apparent space-dyed yarn wherein the process involves selectable control of node position, frequency, randomness, and tightness.

Other objects and benefits of the present invention will become apparent from the following written description and accompanying figures.

BRIEF DESCRIPTION OF THE DRAWINGS

The above and other features of the present invention and the attendant advantages will be readily apparent to those having ordinary skill in the art and the invention will be more easily understood from the following detailed description of the preferred embodiments of the present invention, taken in conjunction with the accompanying drawings, in which like reference numerals refer to like parts throughout the several views.

DESCRIPTION OF THE PREFERRED EMBODIMENTS

Figure 1:
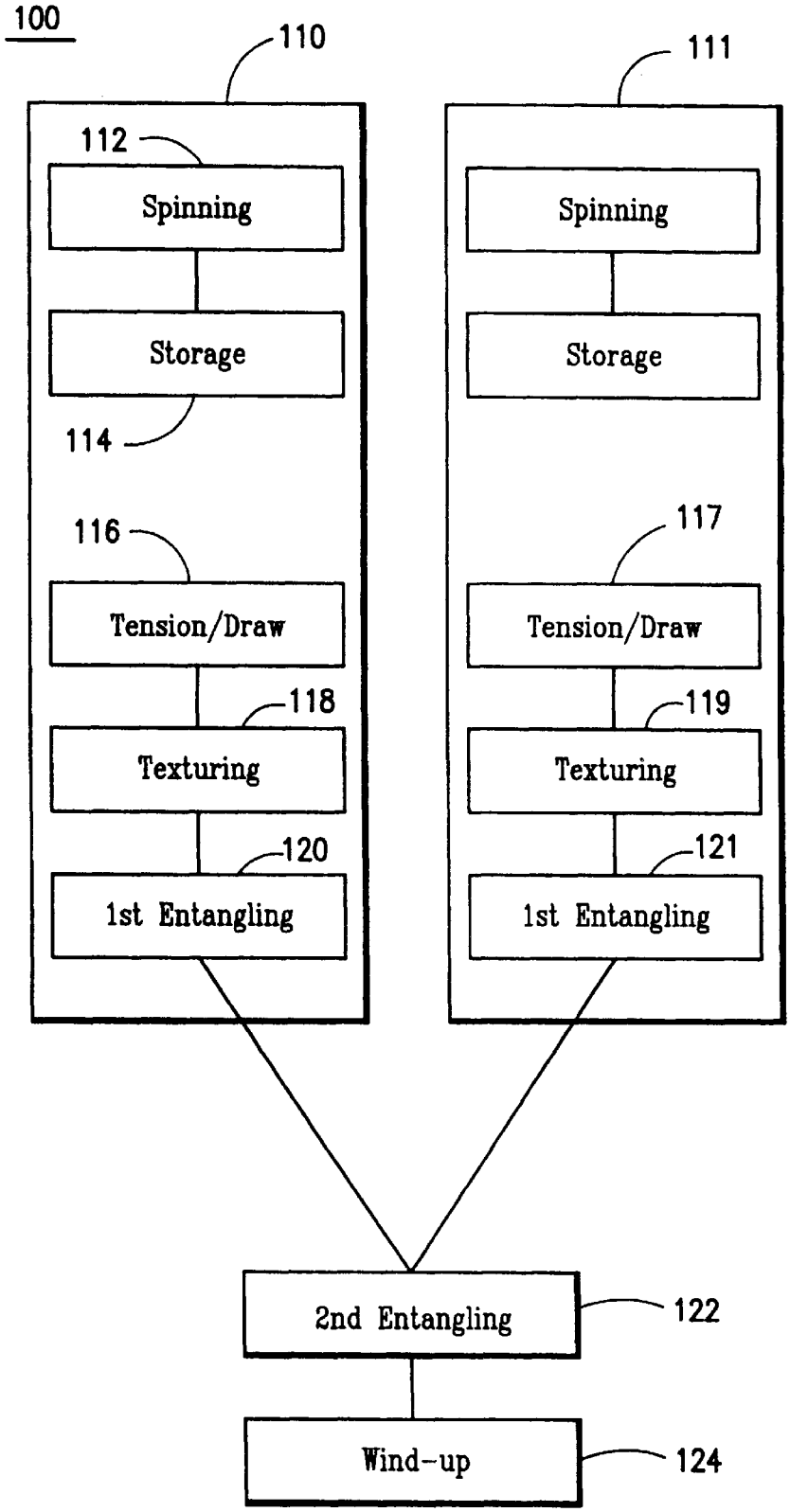
FIG. 1 is a block diagram representing a two-step process according to a preferred embodiment of the present invention.

FIG. 1 is a block diagram representing a two-step process 100, for producing apparent space-dyed yarn according to a preferred embodiment of the present invention. The process includes processing steps for two individual singles yarns 110, 111, although it will readily be recognized that more than two singles yarns will generally be employed in the process. Since each singles yarn is produced and further processed by the same processing steps, it is sufficient to illustrate the processing of two yarns.

In process 100, singles yarns 110, 111 are individually spun in a known manner, preferably in a known solution-dyed melt spinning process, according to any desired spinning schedule. The yarns produced are wound on a storage bobbin or package in an undrawn state. In a second discrete stage or step of the process, singles yarns 110, 111, are individually and simultaneously, but in separate and substantially parallel relationship, processed through sub-steps 116–120, and 117–121, respectively. Process 100 is referred to as a two-step process because the spinning sub-step 112 to storage 114 constitutes a first step. The tension/draw sub-step 116, 117 begins a second, discrete stage or step by drawing a singles yarn from a storage bobbin. Thereafter, the drawn yarns are processed through texturing sub-step 118, 119 and an entangling sub-step 120, 121. The singles yarns 110, 111 are combined at the second entangling sub-step 122, thereby forming an apparent space-dyed yarn, which is then wound up in sub-step 124.

Figure 2:
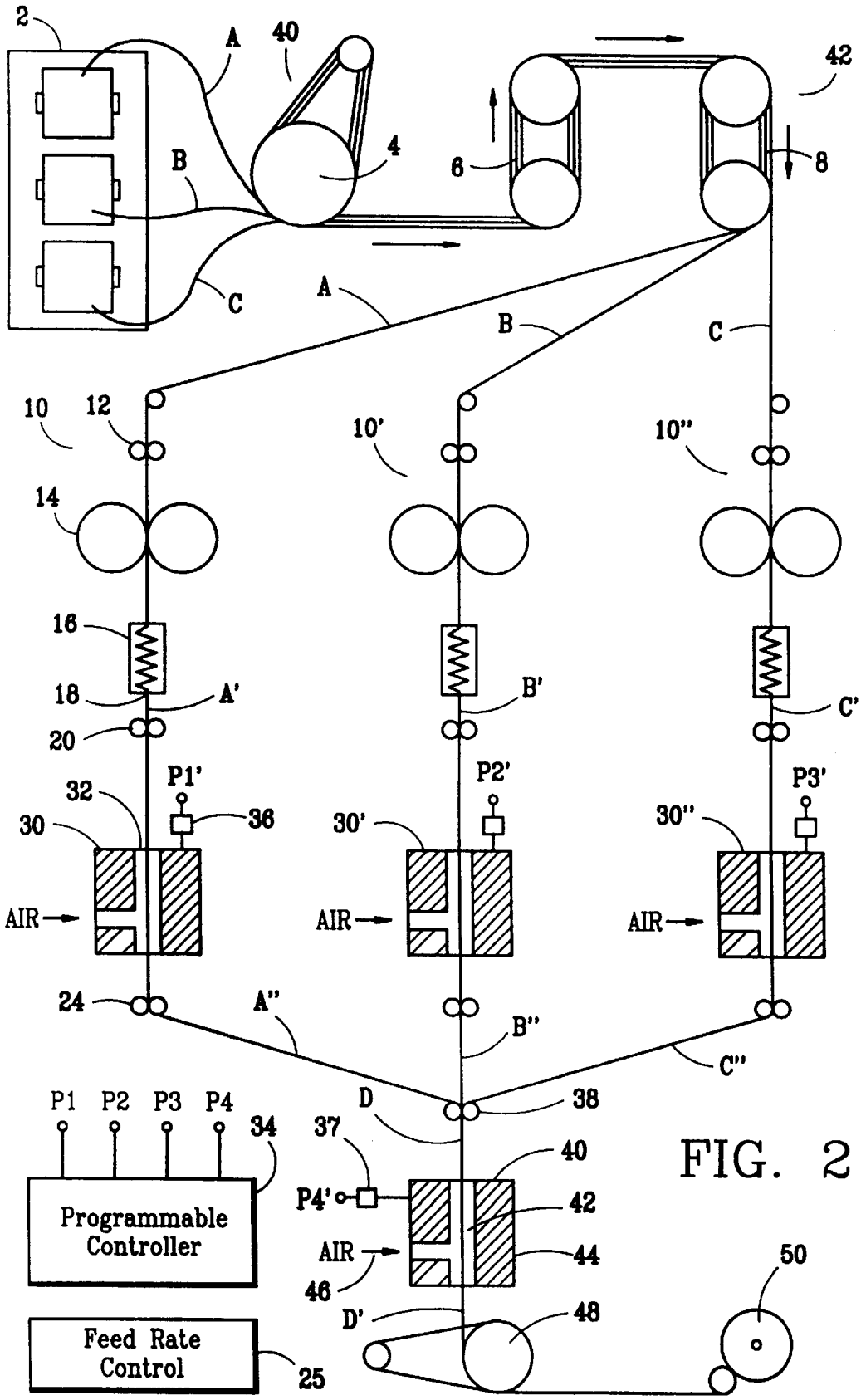
FIG. 2 schematically illustrates an apparatus employing texturing by mechanical crimping according to a preferred embodiment of the present invention FIG. 3 schematically illustrates an apparatus employing texturing by air-jet crimping according to an alternative preferred embodiment of the present invention.

FIG. 2 is a schematic representation of a preferred apparatus of the present invention for performing the second stage or step of the two-stage process 100, illustrated in FIG. 1. Feed yarns A, B, and C represent, as a non-limiting example, two or more pre-spun, pre-colored singles yarns, at least one of which is differentially colored with respect to the other yarns. These singles yarns may preferably be produced in a conventional melt spinning process for producing solution dyed yarns. The yarns, at the commencement of this second stage, are preferably in an undrawn state. The yarns are guided from respective storage bobbins, which preferably comprise tubes upon which undrawn yarn is wound, the bobbins being positioned in a rack 2, and are passed to one or more pretensioning and draw zones, which are configured according to any known method, and which draw the yarn to a desired specification. For example, singles yarns A, B, and C are individually and simultaneously, but in separate and substantially parallel relationship, guided by a grooved roller (not shown) into pretensioning zone 40, which includes a multi-grooved pretensioning godet 4. Optionally, a series of guide pins (not shown), each possibly grooved, may also be used. The pretensioning godet 4 prevents slippage of the singles yarns A, B, and C on the draw rolls and stabilizes yarn movement.

Each singles yarn A, B, and C is supplied to draw zone 42, preferably in the same, separate, substantially parallel relationship as existed in pretensioning zone 40. Draw zone 42 can include any known arrangement of components, for example, two sets of duos having temperature and tensioning presets. For example, the first set of duos 6 heats each yarn. The second set of duos 8 moves faster than the first set, and heats and draws the singles yarns A, B, and C. By adjusting the relative speeds of the duos 6, 8, the draw ratio of the yarns is established.

Because the drawing step is not directly coupled to the spinning step in this process, there is far greater flexibility in establishing a desired draw ratio. In traditional processes in which the fiber is spun, drawn and textured in a single first step prior to being wound and stored, the draw ratio is generally limited to a maximum of 3.0:1, primarily due to melt coloration and additive effects on the process. In the process of the present invention, the range of draw ratios attainable is in the range of about 2.9:1 to about 3.6:1. As a result, the present process permits the production of a much wider range of sizes of the singles yarns, and permits the physical properties of the yarn, such as tenacity and deformation recovery, to be produced in a much broader range.

After exiting the stretching duos 8, the yarns A, B, and C are subsequently cooled and individually and simultaneously textured. This is accomplished by guiding the yarns to individual, respective, texturing zones 10, 10', and 10". Texturing zones 10, 10', and 10" can employ any suitable equipment known in the art. Although the texturing devices shown in FIG. 2 are singular mechancial crimping devices, it should be understood that each texturing device may include a multi-position assembly having several different mechanical crimping devices, one of which would be selected for a specific process. In the present exemplary arrangement, because all of the texturing zones 10, 10', and 10" operate identically and share identical features, only the features of texturing device 10 are identified with reference numerals in FIG. 2 and are discussed herein.

Typically, but not by way of limitation, texturing zone 10 includes a pair of warming rolls 12, a pair of mechanical crimper rolls 14, and a stuffer box 16. The warming rolls 12 both pinch and heat the yarn passing between them, thereby frictionally pulling the yarn from draw zone 42. Warming rolls 12 each have an outer surface maintained at a temperature sufficient to soften the yarn as it passes between the rolls 12 at a preferred feed rate. A pair of crimper rolls 14 are pressed together so as to frictionally pull the yarn passing between them from the warming rolls 12. The outer surface of each crimper roll 14 is configured to permanently deform the yarn into a two dimensional zig-zag pattern.

Stuffer box 16 is configured to receive the yarn output from the pair of crimper rolls 14 and to accumulate the yarn, thereby providing a buffer between the texturing zone 10 and the succeeding entangling step, which advantageously enables a respective singles yarn to be subsequently processed at a carefully regulated yarn tension and speed.

Respective tensioning rolls 20 pull the textured singles yarns (now designated by reference numerals A', B', and C', corresponding to singles yarns A, B, and C), from opening 18 of respective stuffer box 16. Advantageously, a specific feed rate and tension establishing an overfeed condition, with respect to the first air-jet entangling nozzle 30, 30', 30", is established by a cooperative relationship between tensioning rolls 20 located upstream of the nozzle 30, 30', 30" and tensioning rolls 24 located downstream of the nozzle 30, 30', 30". A feed rate of up to 1000 m/min is contemplated at this stage of the process, and, more preferably, a feed rate of 400–600 m/min. is employed. The feed rate of up to 1000 m/min provided by controller 25, in combination with the timing of the programmably controlled air-jet entangler, achieves the desired degree of relatively wide entanglement spacing, while at the same time, resulting in a singles yarn that remains structurally stable throughout the process of making apparent space-dyed yarns. A yarn tension of 50–60 grams is preferably established at the input 22 of the first air-jet entangling nozzle 30, 30', 30", while a 200 gram tension is set at the output 32 of the first air-jet entangling nozzle.

The singles yarns A', B', and C' are individually and simultaneously subjected to intensive entangling nozzles 30, 30', and 30", thereby forming respective entangle-sequenced yarns A", B" and C". Each of the entangled yarns has sequences of entangled and unentangled filaments. Each individual entangling nozzle is connected to a programmable controller 34, which has electrical connections P1, P2, and P3, which are connected to corresponding connections P1', P2', and P3' at respective electronic regulators 36, 37 connected to respective entangling nozzles. Preferably, and not by way of limitation, controller 34 is arranged to provide a predetermined sequence of on-off cycles of pressurized air through the entangling nozzles, which results in sequences of entangled and unentangled fibers in the respective singles yarn. Each individual jet in the first entangling process may operate on the same, or, optionally, on a different timing sequence as the other jets, and the sequences themselves may be even or uneven, i.e., the time-on interval may be the same as, or different than, the time-off interval. Preferably, the on-off cycles of pressurized air are set to 0.3 seconds on, and 0.3 seconds off.

The entangle-sequenced yarns A", B" and C" are physically brought together to form a combined yarn feed D. This may preferably be accomplished by a pretensioning feed roller 38. The combined yarn feed D is guided to the throat 40 of a yarn passage 42 within a single second air-jet entangling nozzle 44. Pressurized air is introduced through passage 46, which is in fluid communication with yarn passage 42, and the pressurized air impacts yarn feed D, resulting in entanglement of the singles yarns A□, B□, C□.

The second air-jet entangling nozzle 44 is also programmably controlled, and operates under the same, or optionally, a different, timing sequence as that of the first set of air-jet entangling nozzles 30, 30', and 30". Electrical connection P4 at controller 34 is connected to connection P4' at entangling nozzle 44. Preferably, the air pressure fed to the second air-jet entangling nozzle 44 is regulated between a first high pressure and a second low pressure, each having a duration of 0.3 seconds. Preferably, the first and second air-jet entangling nozzles are timed such that the second air-jet entangling nozzle 44 is at a high pressure when the first air-jet entangling nozzles 30, 30', 30" are on, and at a low pressure when the first air-jet entangling nozzles 30, 30', 30" are off.

The second air-jet entangling nozzle 44 subjects the combined yarn feed D to entangling, thereby forming a final apparent space-dyed yarn D', having sequences of entangled and unentangled portions of the previously sequentially entangled singles yarns. The feed rate, in combination with the timing of the air-jet entangler, determines the degree of entanglement spacing in the final apparent space-dyed yarn D', and an optimal setting of timing and feed rate causes colors of two or more entangled textured singles yarns to be 15 distinctly, visibly spaced. For a given air-jet entangler pulse rate, too slow a feed rate results in more entangling and a loss of color contrast in the final apparent space-dyed yarn D'. As the feed rate becomes increasingly fast, the color contrast becomes increasingly visibly distinct, but at some point, the widely spaced pattern of entanglement results in a final yarn D' having undesirable properties, such as, for example, poor strength and aesthetic appearance. Therefore, a feed rate of up to 1000 m/min, and preferably 400–600 m/min., with an appropriate air-jet entangler timing sequence, such as, for example, the above-described timing sequence, has been found to achieve desirable properties in the final yarn D'. In the last step, yarn D' is advanced by a feed roller 48 and is guided to a package winding fixture 50.

Figure 3:
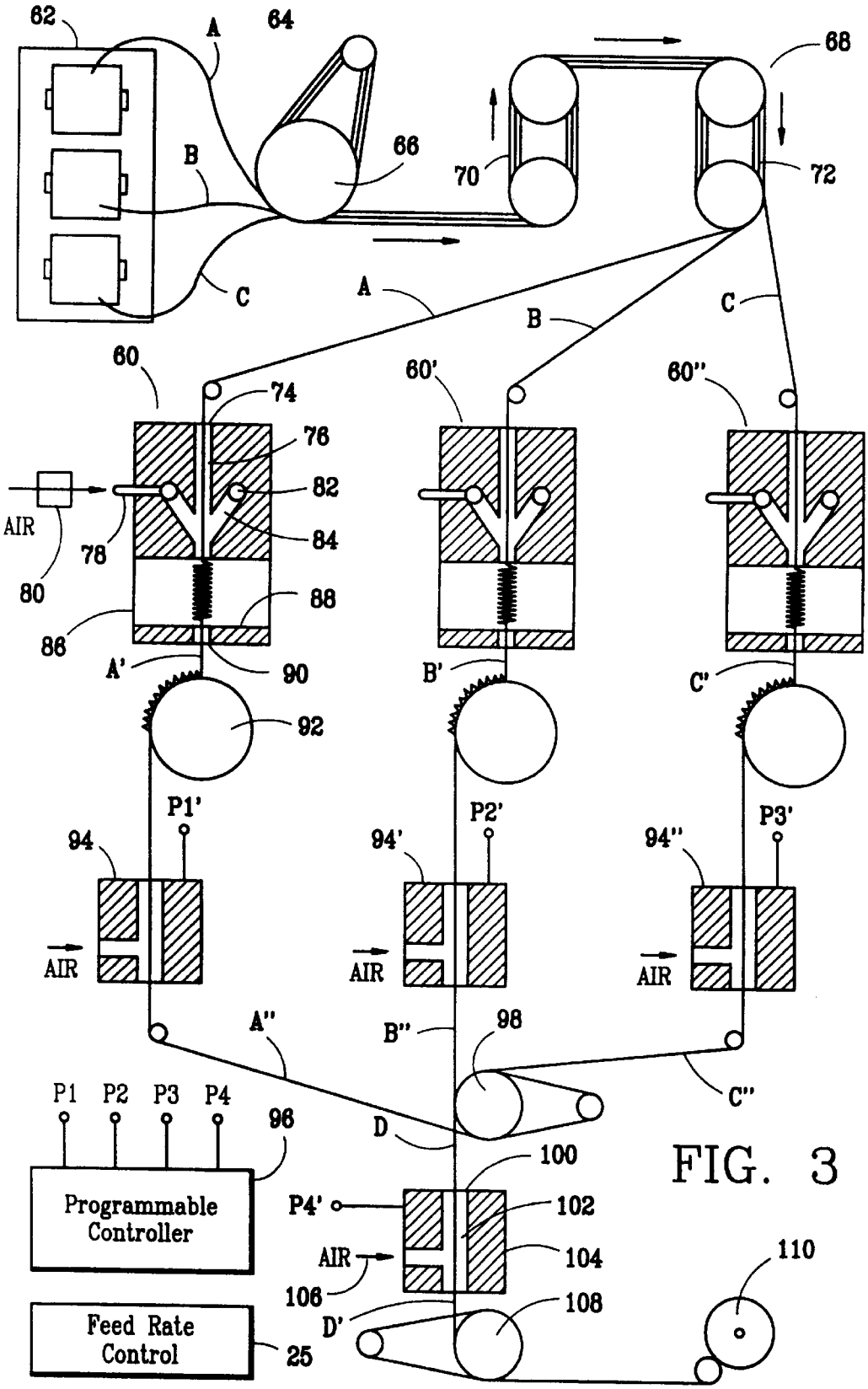

FIG. 3 is a schematic representation of apparatus according to an alternative embodiment of the present invention, in which the mechanical crimping device 10 shown in FIG. 2 is replaced by an air-jet texturing device 60. In FIG. 3, feed yarns A, B, and C represent, as a non-limiting example, two or more pre-spun, pre-colored singles yarns, at least one of which is differentially colored with respect to the other yarns. The yarns are guided from respective storage bobbins, which preferably comprise tubes upon which undrawn yarn is wound, located in a rack 62 and passed to one or more pretensioning and draw zones, which are configured according to any known method, and which draw the yarn to a desired specification. For example, singles yarns A, B, and C are individually and simultaneously, but in separate and substantially parallel relationship, guided by a grooved roller (not shown) into pretensioning zone 64, which includes a multi-grooved pretensioning godet 66. Optionally, a series of guide pins (not shown), each possibly grooved, may also be used. The pretensioning godet 66 prevents slippage of the singles yarns A, B, and C on the draw rolls and stabilizes yarn movement.

Each singles yarn A, B, and C is supplied to draw zone 68, preferably in the same, separate, substantially parallel relationship as existed in pretensioning zone 64. Draw zone 68 can include any known arrangement of components, for example, two sets of duos having temperature and tensioning presets. For example, the first set of duos 70 heats each yarn. The second set of duos 72 moves faster than the first set, and heats and draws the singles yarns A, B, and C. By adjusting the relative speeds of the duos 70, 72, the draw ratio of the yarns is established. As was the case with the previous embodiment, draw ratios of up to 3.6:1 may advantageously be selected for use.

After exiting the stretching duo 72, the yarns A, B, and C are individually and simultaneously texturized. This is accomplished by guiding the yarns to individual, respective, air-jet texturing devices 60, 60', and 60".

The air-jet texturing devices shown in FIG. 3 are singular devices, however, it should be understood that each texturing device may include a multi-position manifold assembly having several different texturing devices, one of which would be selected for a specific process. In the present exemplary arrangement, because all of the air-jet texturing devices 60, 60', and 60" operate identically and share identical features, only the features of texturing device 60 are identified with reference numerals in FIG. 3 and are discussed herein. Typically, but not by way of limitation, texturing device 60 includes an entrance portion 74 and a yarn channel 76. The entrance portion 74 is supplied with a flow of heated gas or vapor, such as hot air or steam. The embodiment illustrated in FIG. 3 employs pressurized air provided from a source thereof by way of a conduit 78. The pressurized air is heated by a heater 80. The heated air is then blown into yarn channel 76 by way of an annular channel 82 and injection channels 84, which are angled relative to the yarn channel 76 such that the air injected into the yarn channel travels parallel to the direction of yarn travel. This directed flow of pressurized air operates to advance the singles yarns A, B, and C from the stretching duo 72 into and through the yarn channel 76.

Yarn channel 76 is connected to a chamber 86, within which the yarn is piled up, thereby forming a plug or wad. As is typical of known chambers, movement of singles yarn A into chamber 86 causes the yarn to collide initially with end wall 88, and subsequently with itself, thus forming bends and similar shapes, called crimps. Because the singles yarn has been exposed to heated air, the yarn is softened, these crimps will be substantially permanent. The yarn plug or wad is subjected to heated airflow, and, at a relatively slow rate, singles yarn A is pressed out of chamber 86.

The textured singles yarns (now designated by reference numerals A', B', and C', corresponding to singles yarns A, B, and C) exit the respective chambers 86 through respective openings 90 and are then cooled by any known method, for example, by guiding the yarns across the porous surfaces of rotating cooling drums 92. The cooling drums 92 may be any suitable configuration presently known in the art. For example, a vacuum drawn in the interior of the cooling drum 92 can be used to cause ambient air to flow through the yarn which contacts the porous outer surface of the drum 92. After cooling, the singles yarns A', B', and C' are individually and simultaneously subjected to intensive entangling by a plurality of first air-jet entangling nozzles 94, 94', and 94", thereby forming respective entangle-sequenced yarns A", B" and C". Each of the entangled yarns has sequences of entangled and unentangled fibers. Each individual entangling nozzle is connected to a programmable controller 96, which has electrical connections P1, P2, and P3, which are connected to corresponding connections P1', P2', and P3', at respective entangling nozzles. Controller 96 is arranged to provide a pre-determined sequence of on-off cycles of pressurized air through the entangling nozzles, which results in sequences of entangled and unentangled fibers in the respective singles yarn. Each individual jet in the first entangling process may operate on the same, or, optionally, on a different timing sequence as the other jets, and the sequences themselves may be even or uneven, i.e., the time-on interval may be the same as, or different than, the time-off interval.

The entangle-sequenced yarns A", B" and C" are combined together to form a combined yarn feed D. This may preferably be accomplished by a pretensioning feed roller 98. The combined yarn feed D is guided to the throat 100 of a yarn passage 102 within a single second air-jet entangling nozzle 104. Pressurized air is introduced through passage 106, which is in fluid communication with yarn passage 104, and the pressurized air impacts yarn feed D, resulting in entanglement of the yarns making up yarn feed D.

The second air-jet entangling step is also programmably controlled, and operates under the same, or optionally, a different, timing sequence as that of the first set of air-jet entanglers 94, 94', and 94". Electrical connection P4 at controller 96 is connected to connection P4' at entangling nozzle 104. The second air-jet entangling nozzle 104 subjects the combined yarn feed D to entangling, thereby forming a final apparent space-dyed yarn D', having sequences of entangled and unentangled portions of the previously sequentially entangled fibers. Finally, the apparent space-dyed yarn D' is advanced by a feed roller 108 and is guided to a package winding fixture 110.

Example A

Five storage bobbins or packages of 1850/30Y (1850 denier, 30 filament, Y cross-section) sulfonated Nylon 66 yarn, each solution dyed to a different color, were set up to be drawn, textured and entangled in a discrete process. The yarns were taken form the bobbins, and were individually drawn, over a standard Godet apparatus, to provide five 600/30Y singles yarns. The drawn yarns were then individually and simultaneously mechanically textured and momentarily accumulated in a stuffer box. The textured singles yarns were then fed to individual air-jet entanglers simultaneously, where each jet was programmed to provide the same sequence of 0.3 sec. on/0.3 sec. off, resulting in evenly spaced, long, sequences or sections of entangled and unentangled singles yarn. The singles yarns were then entangled together in a second entanglement stage using a single airjet entangler programmed to the same time sequence as those utilized in the first entanglement stage. In this second entanglement, the jet was at high pressure when the first jets were off, and at low pressure when the first jets were on. The resultant yarn was then wound up. The wind-up speed was 600 m/min, with a final yarn tension of 125 g. The resulting yarn exhibited highly visible color pop when tufted into a carpet sample. The tufted patterns achieved in this example have the same aesthetically pleasing appearance as exhibited by known space dyed yarns.

Singles yarns for use in the final apparent space-dyed yarns may be based on any spinnable polymer, and preferably melt-spinnable polymers such as polyamides, polyesters, and polyolefins. Representative polymers which would be particularly well suited for use in this invention include Nylon 6, Nylon 66, PET, PBT, PTT, PP, and copolymers and blends thereof. Singles yarns used in forming the apparent space-dyed yarns in the present invention are continuous filament yarns, preferably partially oriented yarns (POY), preferably in their as-spun condition. It is to be noted that polymer of any of the above-noted types obtained from reclaimed or recycled spun fibers, fabric or plastic scrap, or mixtures or combinations thereof, can advantageously be used in this process.

The polymeric singles yarns may be colored using methods known to those skilled in the art, either with dyes or with pigments. Melt pigmentation employing inorganic and/or organic pigments may be the preferred method of coloration for most applications. Additives may be included in the polymeric singles yarns, including, but not limited to, antioxidants, delustrants, antimicrobials, UV stabilizers, stainblockers, and process aids. In addition, while the specific example given is directed to the use of filaments of a trilobal "Y" cross-section the invention is plainly suitable for use with filaments of any other cross-section.

While this invention has been described in conjunction with specific embodiments thereof, it is evident that many alternative modifications and variations will be apparent to those skilled in the art. Accordingly, the preferred embodiments of the invention as set forth herein are intended to be illustrative, not limiting. Various changes may be made without departing from the true spirit and scope of the invention as defined in the following claims.

What is claimed is:

1. A process for producing apparent space-dyed bulked continuous filament yarn comprising the sequential steps of:

individually and simultaneously drawing two or more pre-spun, pre-colored singles yarns, at least one of said singles yarns being differentially colored with respect to the other singles yarns;

individually and simultaneously texturing the two or more singles yarns;

individually and simultaneously entangling the two or more textured singles yarns to form respective two or more entangle-sequenced yarns each having fiber portions having sequences of entangled and unentangled fibers;

together entangling the two or more entangle-sequenced yarns to form a final apparent space-dyed yarn; and winding up the final apparent space-dyed yarn, wherein the step of individually and simultaneously entangling the two or more textured singles yarns comprises:

controlling at least one first nozzle assembly by providing to said at least one first nozzle a first pressurized air setting of a repeating on-off sequence; and the step of together entangling the two or more entangle-sequenced yarns comprises:

controlling a second nozzle assembly by providing to said second nozzle assembly a second pressurized air setting of a repeating pressure sequence of high and low pressure, wherein said second pressurized air setting is timed such that the second nozzle assembly is at a high pressure when the at least one first nozzle is on, and at a low pressure when the at least one first nozzle is off.

2. The process of claim 1 wherein said step of individually and simultaneously drawing two or more pre-spun, pre-colored singles yarns includes the step of unwinding said pre-spun, undrawn, yarns from storage bobbins.

3. The process of claim 1 wherein the repeating on-off sequence is a repeating sequence of 0.3 seconds on and 0.3 seconds off.

4. The process of claim 1 wherein the repeating pressure sequence is a repeating sequence of 0.3 seconds high pressure and 0.3 seconds low pressure.

5. The process of claim 1 wherein the step of individually and simultaneously texturing the two or more singles yarns comprises individually mechanically texturing said two or more singles yarns.

6. The process of claim 1 further comprising a singles yarn feed rate of up to 1000 m/min and an entanglement spacing arranged to cause colors of the two or more entangled textured singles yarns to be distinctly visibly spaced.

7. The process of claim 6, wherein said singles yarn feed rate is 400–600 m/min.

8. The process of claim 1 wherein said step of individually and simultaneously drawing two or more pre-spun, pre-colored singles yarns further comprises a draw ratio of about 2.9:1 to about 3.6:1.

* * * * *